US005778086A

United States Patent [19]

Tanabe

[11] Patent Number: 5,778,086

[45] Date of Patent: Jul. 7, 1998

[54] ELECTRONIC DEVICE CONNECTION TERMINAL

[75] Inventor: Kei Tanabe, Iwaki, Japan

[73] Assignee: Alpine Electronics, Inc., Tokyo, Japan

[21] Appl. No.: 627,961

[22] Filed: Apr. 2, 1996

[30] Foreign Application Priority Data

Apr. 6, 1995 [JP] Japan ..... 7-106954

[51] Int. Cl.[6] ..... H04R 25/00

[52] U.S. Cl. ..... 381/192; 381/194; 439/736

[58] Field of Search ..... 381/192, 194, 381/199, 188, 205, 195, 197, 59, 117; 439/736, 869, 871; 29/845

[56] References Cited

U.S. PATENT DOCUMENTS 4,829,582 5/1989 Heuvinck ..... 381/194
4,915,647 4/1990 Edgley et al. ..... 439/441
5,091,958 2/1992 Sakamoto ..... 381/194
5,583,944 12/1996 Morohoshi ..... 381/194

*Primary Examiner*—Huyen D. Le
*Attorney, Agent, or Firm*—Guy W. Shoup

[57] ABSTRACT

An electronic device connection terminal including a holder, formed from an insulator, mounted on a metallic frame of the electronic device, and a metallic terminal embedded in the holder and having one end protruding from the holder inside of the frame, the metallic terminal having connected thereto a lead wire extending from an electronic circuit located inside the frame. An insulation wall extends from the holder to oppose the lead wire retained by the metallic terminal and is interposed between the metallic terminal and the inner wall of the frame. The insulation wall is integrally formed with the holder in order to prevent a short circuit of the lead wire to the inner wall of the frame.

22 Claims, 3 Drawing Sheets

ELECTRONIC DEVICE CONNECTION TERMINAL

BACKGROUND OF THE INVENTION

1. Field of the Invention

The present invention relates to an electronic device connection terminal of the insertion type which is mounted on a metallic frame of an electronic device such as a speaker, and more particularly to an electronic device connection terminal which prevents a lead wire, which is retained by a metallic terminal, from contacting the metallic frame, thereby preventing a short circuit.

2. Description of the Related Art

FIG. 5 is a perspective view of an electronic device connection terminal, and FIG. 6 is a cross sectional view of the connection terminal being mounted on a metallic frame.

In the connection terminal A of FIG. 5, reference numeral 1 denotes a metallic terminal which is embedded in a holder 3 which is formed from an insulator material such as, for example, resin. The metallic terminal 1 protrudes out from the upper and lower ends of the holder 3, the upper protruding portion being designated upper terminal portion 1*a* and the lower protruding portion being designated lower terminal portion 1*b*. Lead wire mounting terminal holes 2*a* and 2*b* are formed in the upper terminal portion 1*a* and the lower terminal portion 1*b*, respectively.

The holder 3 is primarily composed of a cylindrical upper holder member 3*a* and a flanged base 3*b* formed below and having a larger diameter than the upper holder member 3*a*. The resinous insulation material of the holder 3 is molded around the aforementioned metallic terminal 1 to produce an integral structure.

As illustrated in FIG. 6, the connection terminal A is secured to a metallic frame 4 which separates the inner and outer sides of the electronic device. For example, the connection terminal A is secured to the metallic frame 4 by inserting the upper holder member 3*a* into a mounting hole 4*a* in the metallic frame 4 from the outer side, and then bonding and securing the holder 3 to the metallic frame 4.

After securing the connection terminal A to the metallic frame 4, the end portion of a conductor of a lead wire 5 (which is disposed inside the metallic frame 4) is inserted into the aforementioned terminal hole 2*a* and then soldered. The lower terminal portion 1*b* protrudes outside the metallic frame 4. Either an external wire (not shown) is inserted into the terminal hole 2*b* and soldered to the lower terminal portion 1*b*, or an external circuit connector is connected to the lower terminal portion 1*b*.

When the conductor 6 of the lead wire 5 is inserted into the terminal hole 2*a*, a portion of the conductor, being of some length, protrudes below the upper terminal portion 1*a*. This protruding portion of the conductor 6 is cut, for example, substantially along the line VI—VI of FIG. 6. (This part of the conductor will hereinafter be referred to as protruding end portion 6*a*.)

As illustrated in FIG. 6, a horizontal section 4*b* of the metallic frame 4 is disposed near the mounting hole 4*a* formed in the metallic frame 4, and the inner wall of the horizontal section 4*b* is disposed near the upper terminal 1*a*. This often causes the protruding end portion 6*a* of the conductor 6 inserted through the terminal hole 2*a* to contact the inner wall of the horizontal section 4*b* because the upper terminal portion 1*a* and the inner wall of the horizontal section 4*b* are separated by a very small distance L. When the aforementioned distance L is small, there is not enough space to insert a tool such as a nipper, thereby making it impossible to actually cut the protruding end portion 6*a* of the conductor 6. This leads to the possibility of a short circuit caused by contact between the conductor 6 and the metallic frame 4.

For example, a voice current applied to the metallic terminal 1 from the external circuit when using the aforementioned connection terminal A in a speaker may result in a short circuit to the metallic frame 4.

SUMMARY OF THE INVENTION

Accordingly, an object of the present invention is to provide an electronic device connection terminal in which an insulation wall is disposed so as to oppose an end portion of a lead wire in order to prevent the lead wire from causing a short circuit by contacting, for example, the inner wall of a metallic frame of the electronic device. With this connection terminal, even if the protruding end portion of the conductor extending from the metallic terminal is too long, the insulation wall prevents the protruding end portion from contacting the metallic frame, thereby simplifying the assembly process by making it unnecessary to cut the wire.

The connection terminal includes a holder, formed from an electrically insulating material, which is mounted on a frame of an electronic device and includes a metallic terminal embedded therein, the metallic terminal having connected thereto a lead wire disposed inside the frame, wherein an insulation wall disposed so as to oppose an end of the lead wire is integrally formed (molded) with said holder.

The insulation wall of the holder is positioned between the metallic terminal (to which the lead wire is soldered) and the metallic frame, thereby preventing a short circuit due to contact between the lead wire and the inner wall of the metallic frame.

More specifically, the insulation wall is formed parallel to the metallic terminal and spaced therefrom by a small distance. In one embodiment of the connection terminal, in which the lead wire is inserted and soldered in a terminal hole or groove of the metallic terminal, the insulation wall is disposed so as to oppose the end portion of the lead wire inserted in the metallic terminal. In this case, the insulation wall not only functions to insulate the end portion of the lead wire, but also retains the end portion of the lead wire, thereby serving as a receiver section or a stopper to limit the amount of protrusion of the lead wire from the metallic terminal. In order to allow the insulation wall to function fully as an insulator and a receiver section, it is preferable that the length and width of the protruding insulation wall be greater than the length and width of the metallic terminal protruding from the holder.

In addition, although the disclosed insulation wall extends in a tabular form along the back face of the metallic terminal, it may also be formed, for example, into a semi-cylindrical wall extending from the holder such that it surrounds the metallic terminal. Further, the insulation wall may cover the portion of the metallic terminal protruding from the holder. Formation of the insulation wall in such a fashion greatly improves insulation. Therefore, it is very effective to form the insulator wall in this way when the component parts are crowded together.

Although the disclosed metallic terminal is generally formed into a thin tabular shape, has either a terminal hole or a groove formed in each end portion, and a lead terminal is soldered in the hole or the groove, other metallic terminal structures may also be used. For example, a thin and long metallic terminal having, for example, a square-shaped cross section may also be used as a wrapping connection terminal.

In addition, although in the foregoing description the insulation wall was provided only near one of the terminal portions, insulation walls can also be formed near both end portions of the connection terminal located inside and outside of the frame, when necessary, since the metallic terminal protrudes from both ends of the holder.

In the present invention, the insulation wall extends from the insulator holder such that the wall extends parallel to the metallic terminal of the connection terminal. For example, as illustrated in FIG. 1, the insulation wall protrudes from the holder and is spaced apart from the back face of the upper metallic terminal portion.

When the conductor of the lead wire inserted into the terminal hole of the upper metallic terminal is too long, the end of the conductor will come into contact and rest on the insulation wall. Since the insulation wall has a longer length and a wider width than the upper metallic terminal portion, the insulation wall prevents the conductor from extending beyond the insulation wall to contact the metallic frame. Therefore, after the conductor has been secured to the upper terminal portion by soldering, it is no longer necessary to cut the portion of the conductor protruding from the upper terminal portion.

Since the distance between the metallic terminal and the insulation wall is predetermined, it is easier to set the length of the conductor when mounting the lead wire to the metallic terminal. In addition, since soldering is carried out when the end of the lead wire contacts the insulation wall, it is possible to achieve a time-efficient process for connecting the lead wire to the metallic terminal.

When the holder is disposed near the deformed section such as the erected wall portion of the metallic frame of, for example, a speaker, the insulation wall is interposed between the metallic terminal and the inner wall of the metallic frame. In this case, the insulation wall is disposed so as to oppose the lead wire retained by the metallic terminal, which makes it possible to prevent a short circuit resulting from contact between the lead wire and the metallic frame. In the present invention, although the insulation layer is placed near a metallic frame to prevent short-circuit of the lead wire, it may also be placed between the metallic terminal and the conductive section of a shield case or a terminal of another electronic component part, or a conduction pattern of another circuit substrate in order to prevent the lead wire from being short-circuited to the conductive section thereof.

DESCRIPTION OF THE PREFERRED EMBODIMENTS

Figure 5:
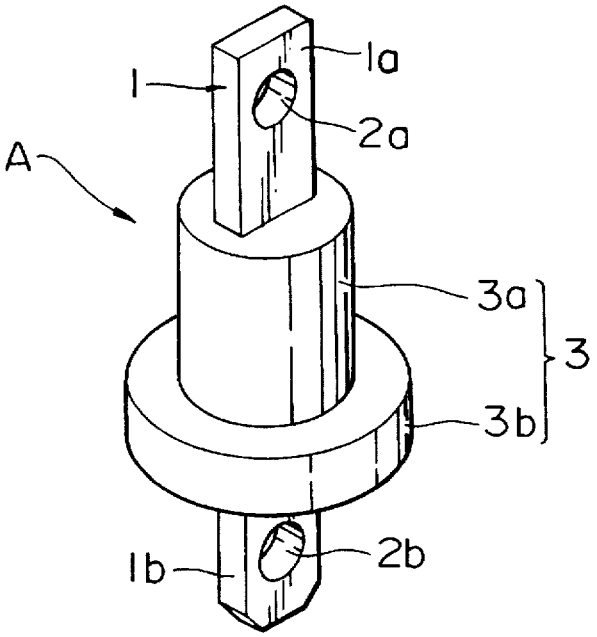
FIG. 5 is a perspective view of a known connection terminal.
Figure 6:
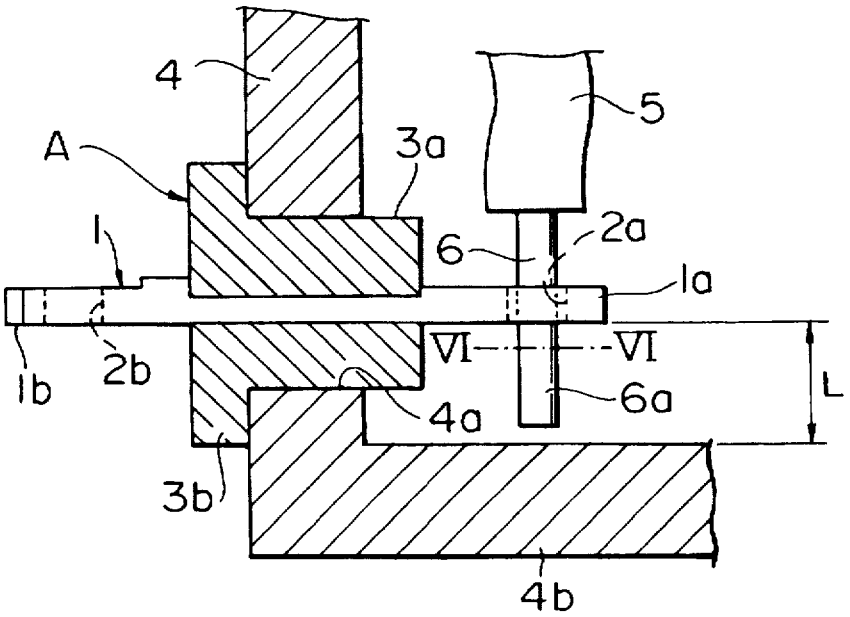
FIG. 6 is a cross sectional view of the connection terminal of FIG. 5 mounted on a frame.

A description will now be given of the preferred embodiments of the present invention. In the following description, parts which correspond to those of FIGS. 5 and 6 are designated using common reference numerals.

Figure 1:
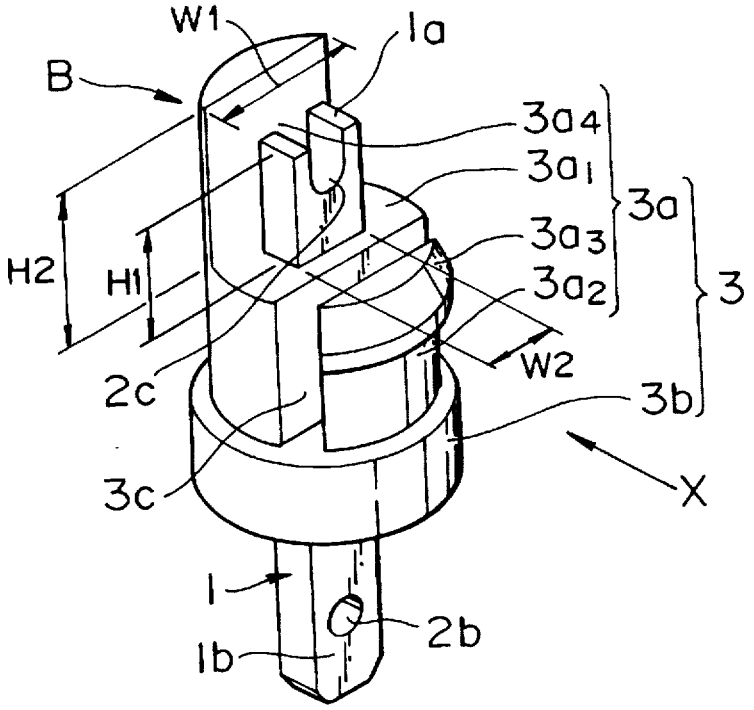
FIG. 1 is a perspective view of a connection terminal of the present invention.
Figure 2:
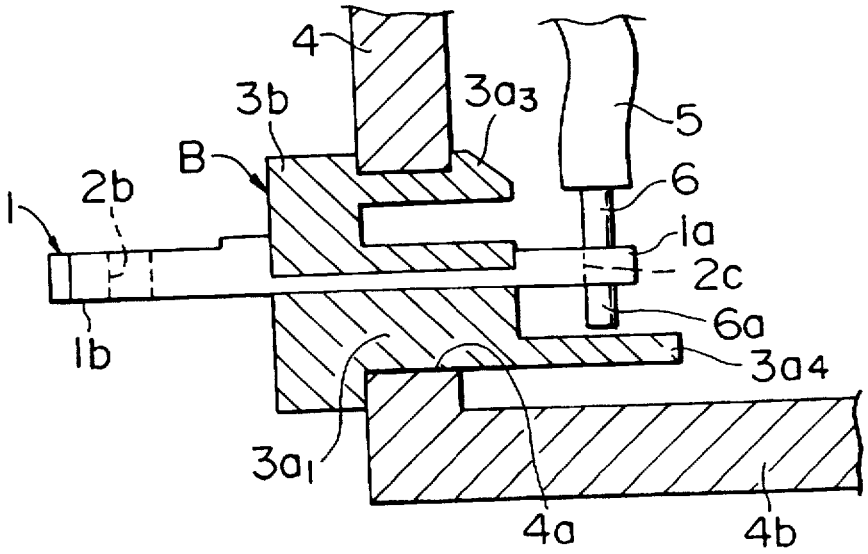
FIG. 2 is a cross sectional view of the connection terminal of FIG. 1 mounted on a frame.

FIG. 1 is a perspective view of a connection terminal of the present invention. FIG. 2 is a cross sectional view of the connection terminal of FIG. 1 mounted on a metallic frame.

Figure 3:
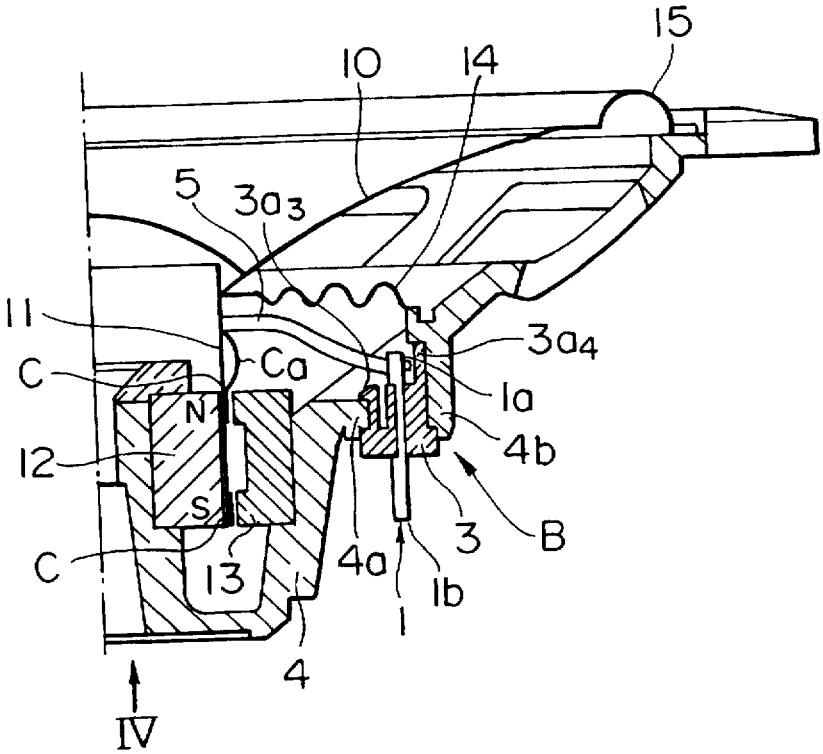
FIG. 3 is a cross sectional view of a speaker to which the connection terminal of the present invention is mounted.
Figure 4:
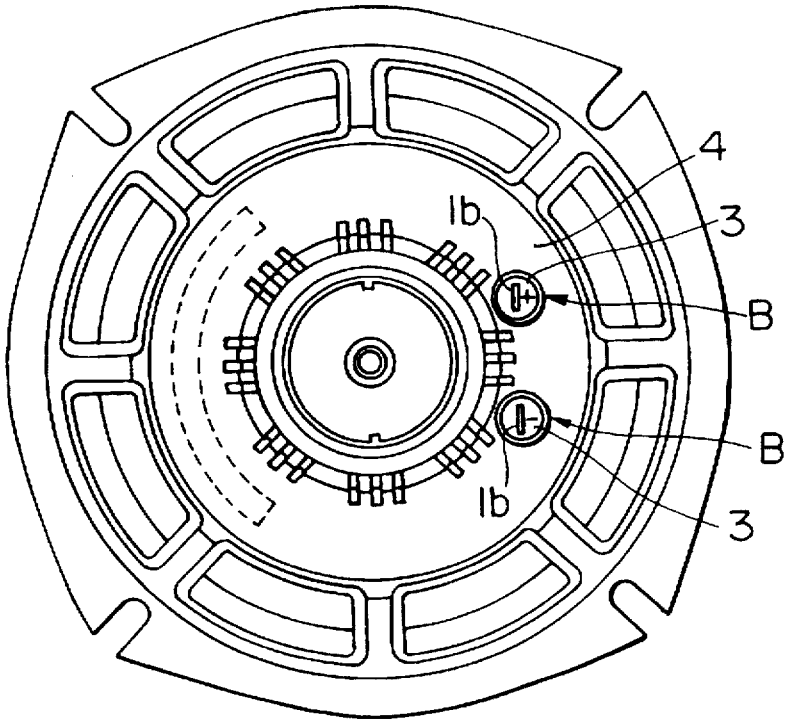
FIG. 4 is a bottom view taken along arrow IV of FIG. 3.

FIG. 3 is a semi-cross sectional view of a speaker, used as an example of an electronic device, illustrating a use of the connection terminal of the present invention. FIG. 4 is a bottom view taken along arrow IV of FIG. 3.

The connection terminal B of FIG. 1 includes a holder 3 which is formed from an insulation material such as, for example, resin. The holder 3 includes an upper holder member (insertion portion) 3*a* protruding from a base 3*b*, the upper holder member 3*a* having a smaller diameter than the base 3*b* and being divided into two portions by a groove 3*c*. One of the divided portions is a first upper holder portion $3a_1$. A tabular insulation wall $3a_4$ made of resinous material forms a continuation of the first holder portion $3a_1$ and extends from an upper face thereof. The other divided part is a second upper holder portion $3a_2$ disposed so as to oppose the first upper holder portion $3a_1$ and separated therefrom by the groove 3*c*. A partly truncated conical retainer protrusion $3a_3$ is formed at the outer peripheral surface of an end of the second upper holder portion $3a_2$.

A metallic terminal 1 is embedded in the first upper holder portion $3a_1$ and the base 3*b* such that an upper terminal portion 1*a* and a lower terminal portion 1*b* protrude from the first upper holder portion $3a_1$ and the base 3*b*, respectively. The aforementioned first upper holder portion $3a_1$, the second upper holder portion $3a_2$, the retainer protrusion $3a_3$, the insulation wall $3a_4$, and the base 3*b* are preferably produced by injecting molding resinous material into a die in which the metallic terminal is inserted, resulting in the so-called out-sert molding process.

A height H2 of the insulation wall $3a_4$, which protrudes from an upper surface of the first upper holder portion $3a_1$, is greater than a height H1 of the upper terminal portion 1*a*, which also protrudes from the first upper holder portion $3a_1$, in a direction which is parallel to the insulation wall $3a_4$. In addition, a width W1 of the insulation wall $3a_4$ is wider than a width W2 of the upper terminal portion 1*a*. Accordingly, when the connection terminal is viewed from direction X, the upper terminal portion 1*a* is contained within the area of the insulation wall $3a_4$. Therefore, the end portion of the conductor 6 soldered to the upper terminal portion 1*a* will not extend beyond the insulation wall $3a_4$.

The metallic terminal 1 includes a U-shaped groove 2*c* formed in the upper terminal portion 1*a*, and a terminal hole 2*b* formed in the lower terminal portion 1*b*. Conductors of lead wires are retained in and soldered to the groove 2*c* and the terminal hole 2*b*. It is to be noted that a V-shaped groove can be used in place of the U-shaped groove 2*c*, and that the terminal hole can be punched in the upper terminal portion 1*a*.

Referring to FIG. 2, the holder 3 is inserted from the outer side into a mounting hole 4*a* formed in a metallic frame 4 of an electronic device. At this time, the second upper holder portion $3a_2$, which is separated from the first upper holder portion $3a_1$ by the aforementioned groove 3*c*, is resiliently bent at its base toward the first upper holder portion $3a_1$. Accordingly, when the upper holder member 3*a* is inserted into the mounting hole 4*a*, the second upper holder portion $3a_2$ is initially deformed and then springs back to its original shape due to its elasticity after passing through the mounting hole 4*a*, so that the retainer protrusion $3a_3$ is retained by the inner face of the metallic frame 4, as illustrated in FIG. 2. At this time, the base 3*b* is in contact with the outer face of the metallic frame 4. The metallic frame 4 is interposed between the base 3b and the retainer protrusion $3a_3$, thereby firmly mounting the connection terminal B to the metallic frame 4.

In the present embodiment, since the aforementioned retainer protrusion $3a_4$ is integrally formed with the holder 3, mounting of the connection terminal B to the metallic frame 4 is accomplished simply by inserting the holder 3 into the mounting hole 4a from the outer face of the metallic frame 4, thereby simplifying the mounting process of the connection terminal B to the metallic frame 4 and making it less likely for the connection terminal B to become disconnected from the metallic frame 4 once it has been mounted thereto.

As illustrated in FIG. 2, the connection terminal B is mounted on the metallic frame 4. A conductor 6 extending from the covering of a lead wire 5 which is located inside of the metallic frame 4 is retained by the U-shaped groove 2c of the upper terminal portion 1a. When the length of the conductor 6 extending out from the covering of the lead wire 5 is too long, a protruding end portion 6a of the conductor 6 protrudes out from the upper terminal portion 1a and contacts the inner face of the insulation wall $3a_4$. In other words, the insulation wall $3a_4$ functions as a receiving section or a stopper, thereby preventing the conductor 6 from extending past the insulation wall $3a_4$ to contact the metallic frame 4.

Accordingly, even when a section 4b of the metallic frame 4 located near the mounting hole 4a is bent or erected such that it is perpendicular to the mounting hole 4a, and even when the mounted connection terminal B is located near the inner wall of the section 4b, it is possible to prevent a short circuit resulting from contact between the protruding end portion 6a of the conductor against the section 4b of the metallic frame 4 by interposing the insulation wall $3a_4$ between the inner wall of the section 4b and the upper terminal portion 1a. In addition, while the connection terminal B is mounted on the metallic frame 4 as illustrated in FIG. 2, the conductor 6 and the upper terminal portion 1a are soldered together, with the length of the protruding end portion 6a being no greater than the distance between the upper terminal portion 1a and the insulation wall $3a_4$. This makes it unnecessary to cut the protruding end portion 6a after soldering.

FIG. 3 illustrates the case where the aforementioned connection terminal B is used as an external wiring terminal for a speaker. It is to be noted that FIG. 2 is substantially an enlarged view of a portion of FIG. 3.

The metallic frame 4 of the speaker of FIG. 3 is formed by die casting conductive materials such as aluminum alloys or zinc alloys. In the example of FIG. 3, the section 4b of the metallic frame 4 is located very close to the mounting hole 4a. Accordingly, with the connection terminal B inserted in the mounting hole 4a, the back face of the insulation wall $3a_4$ is substantially in contact the inner wall of the section 4b.

A conical diaphragm 10 is disposed inside the metallic frame 4. The diaphragm 10 is supported by a suspension 15 at the open side of the metallic frame 4, and is supported by a damper plate 14 inside the metallic frame 4 such that it can vibrate vertically in FIG. 3. A bobbin 11 is connected to the lower end of the diaphragm 10, with voice coils C, C wound upon the bobbin 11. A magnet 12 and a yoke 13 opposite the magnet 12, which form a magnetic circuit, are formed around a common center and at the base end section in the metallic frame 4. The aforementioned voice coils C, C are inserted into a gap formed between the magnet 12 and the yoke 13.

A wire rod Ca, wound to form voice coil C, is soldered onto the outer peripheral face of the bobbin 11 at a junction. Lead wires 5 made of, for example, cotton yarn extend from the junction. In the case of the speaker, the cotton yarn lead wire 5 is retained by and soldered to the upper terminal portion 1a of the metallic terminal 1. In this case, the insulation wall $3a_4$ substantially contacts the inner wall of the section 4b of the metallic frame 4 and opposes the end portion of the cotton yarn lead wire 5, thus preventing a short circuit resulting from contact between the lead wire 5 and the metallic frame 4.

As illustrated in FIG. 4, a pair of connection terminals are provided for the metallic frame 4. The cotton yarn lead wire 5 illustrated in FIG. 3 is connected to each upper terminal portion 1a, 1a, inside the metallic frame 4, of the respective connection terminals B. The lower terminal portions 1b, 1b of each connection terminal B, B protrude outside of the metallic frame 4, and have connected thereto external wiring connectors, respectively. The pair of connection terminals B, B of FIG. 4 exhibit positive and negative electrical polarities. As illustrated in FIG. 4, in order to indicate the electrical polarity the bottom faces of the holders 3 that extend outside of the frame 4, the metallic frame 4 may be marked with a (+) or a (−), or instead may be colored depending on the polarity, or may be marked (+) or (−) and colored with different colors depending on the polarity. In indicating the polarity by coloring, the bottom face of the holder 3 with the positive polarity may, for example, be colored red and the bottom face with the negative polarity may be colored a different color such as white.

Although the connection terminal of the present invention was applied to a speaker, it may also be applied to any other electronic device. In addition, although the metallic frame was disposed so as to oppose the insulation wall $3a_4$, the terminal of a different electronic component part, a shield case, a conductive pattern of a printed board, etc. may be disposed so as to oppose the metallic frame instead.

As can be understood from the foregoing description, according to the present invention, the insulation wall is integrally formed with the holder and is spaced apart from the back face of the metallic terminal, so that the lead wire retained by the metallic terminal is insulated by the insulation wall, thus preventing a short circuit caused by contact with the metallic frame or any other conductive section.

In addition, when soldering the lead wire such that the end portion protrudes out from the metallic terminal, bringing the end portion of the lead wire into contact with the insulation wall which faces the lead wire restricts the amount of protrusion of the lead wire from the metallic terminal, thus making it unnecessary to cut the end portion of the lead wire.

Accordingly, when the end portion of the lead wire extends beyond the metallic terminal and contacts the insulation wall, it no longer becomes necessary to cut the lead wire. In addition, when the lead wire is retained by and soldered to the metallic terminal, it is possible to prevent a short circuit of the lead wire to other conductive sections, thus simplifying the process of connecting the lead wire to the metallic terminal. Even when the metallic terminal is spaced from the frame by a very small distance, a short circuit of the lead wire to the conductive section will not occur, thus facilitating soldering of the lead wire to the metallic terminal.

What is claimed is:

1. A connection terminal for an electronic device, the connection terminal comprising:

a holder integrally formed from an electrically insulating material, the holder including:

a base portion having a first end surface, and an insertion portion extending from the base portion, the insertion portion having a second end surface which is parallel to the first end surface of the base portion; and a metallic terminal embedded in the holder and having a first end protruding from the first end surface of the base portion and a second end protruding from the second end surface of the insertion portion;

wherein the holder includes an insulation wall extending from at least one of the first end surface of the base portion and the second end surface of the insertion portion in a direction which is parallel to at least one of the first end and the second end of the metallic terminal such that the insulation wall is separated from both the first end and the second end of the metallic terminal.

2. The connection terminal according to claim 1, wherein the insulation wall extends from the second end surface of the insertion portion, and wherein a width of the insulation wall is larger than a width of the second end of the metallic terminal.

3. The connection terminal according to claim 1, wherein the insulation wall extends from the second end surface of the insertion portion, and wherein a length of the insulation wall is longer than a length of the second end of the metallic terminal protruding from the insertion portion.

4. The connection terminal according to claim 1, wherein the insulation wall extends from the second end surface of the insertion portion, and wherein the insertion portion includes a first portion from which the second end of the metallic terminal protrudes, a second portion separated from the first portion by a groove, the second portion being resiliently bendable toward the first portion, and a retainer protrusion formed at a free end of the second portion.

5. The connection terminal according to claim 1, wherein one of a hole and a groove is formed in each of the first and second ends of the metallic terminal.

6. An electronic device comprising:

a frame having an external surface and an interior portion, the frame defining a mounting hole extending from the external surface to the interior portion;

an electronic circuit mounted in the interior portion of the frame;

a lead wire connected to the electronic circuit and having a terminal end; and a connection terminal including:

a first holder integrally formed from an electrically insulating material, the first holder including:

a base portion having a first end surface, and an insertion portion extending from the base portion through the mounting hole, the insertion portion having a second end surface which is parallel to the first end surface of the base portion; and a first metallic terminal embedded in the first holder and having a first end protruding from the first end surface of the base portion and a second end protruding from the second end surface of the insertion portion;

wherein the terminal end of the lead wire is connected to one of the first end and the second end of the first metallic terminal; and wherein the first holder includes an insulation wall extending from at least one of the first end surface of the base portion and the second end surface of the insertion portion which is positioned between the terminal end of the lead wire and a portion of the frame.

7. The electronic device according to claim 6, wherein the insulation wall extends from the second end surface of the insertion portion, and wherein the insulation wall extends substantially parallel to the second end of the first metallic terminal, the first metallic terminal having formed in each of the first and second ends one of a hole and a groove for receiving the terminal end of the lead wire, the insulation wall being disposed so as to oppose the terminal end of the lead wire when it is received in the hole or the groove.

8. The electronic device according to claim 6, wherein the insulation wall extends from the second end surface of the insertion portion, and wherein a width of the insulation wall is larger than a width of the second end of the first metallic terminal.

9. The electronic device according to claim 6, wherein the insulation wall extends from the second end surface of the insertion portion, and wherein a length of the insulation wall from the insertion portion is longer than the length of the second end of the first metallic terminal.

10. The electronic device according to claim 6, wherein the insulation wall extends from the second end surface of the insertion portion, and wherein the insertion portion includes a first portion from which the second end of the metallic terminal protrudes, a second portion separated from the first portion by a groove, the second portion being resiliently bendable toward the first portion, and a retainer protrusion formed at a free end of the second portion.

11. The electronic device according to claim 6, further comprising a second connection terminal having a second holder and a second metallic terminal embedded therein, wherein the first end surface of each of the first and second holders extending outside the frame being marked to indicate the electrical polarity of each of the first and second metallic terminals.

12. The electronic device according to claim 6, wherein a second connection terminal is mounted on the frame, the second connection terminal having embedded therein a second metallic terminal, wherein a face of each of the connection terminal and the second connection terminal is colored to indicate an electrical polarity of each of the metallic terminal and the second metallic terminal.

13. The electronic device according to claim 6, wherein a second connection terminal is mounted on the frame, the second connection terminal having embedded therein a second metallic terminal, and wherein a face of each of the connection terminal and the second connection terminal is marked to indicate the electrical polarity of each of the metallic terminal and the second metallic terminal.

14. A speaker comprising:

a frame having an external surface and an interior portion, the frame defining a mounting hole extending from the external surface to the interior portion;

a diaphragm supported on the frame;

a bobbin attached to the diaphragm and located in the interior portion of the frame;

a coil wound on the bobbin;

a lead wire connected to the coil and having a terminal end; and a connection terminal including:

a first holder integrally formed from an electrically insulating material, the first holder including:

a base portion having a first end surface, and an insertion portion extending from the base portion through the mounting hole, the insertion portion having a second end surface which is parallel to the first end surface of the base portion; and a first metallic terminal embedded in the first holder and having a first end protruding from the first end surface of the base portion and a second end protruding from the second end surface of the insertion portion;

wherein the terminal end of the lead wire is connected to one of the first end and the second end of the first metallic terminal; and wherein the first holder includes an insulation wall extending from at least one of the first end surface of the base portion and the second end surface of the insertion portion which is positioned between the terminal end of the lead wire and a portion of the frame.

15. The speaker according to claim 14, wherein the insulation wall extends from the second end surface of the insertion portion, and wherein the frame is made of conductive material and wherein the insulation wall is interposed between the second end of the first metallic terminal and an inner wall of the frame disposed near the second end of the first metallic terminal in order to prevent a short circuit of the lead wire to the inner wall of the frame.

16. The speaker according to claim 14, wherein the insulation wall extends substantially parallel to the first metallic terminal, the first metallic terminal having formed in each end a hole or a groove for receiving the lead wire, the insulation wall being disposed so as to oppose the end portion of the lead wire to be received in the hole or the groove.

17. The speaker according to claim 14, wherein the insulation wall extends from the second end surface of the insertion portion, and wherein a width of the insulation wall is larger than a width of the second end of the first metallic terminal.

18. The speaker according to claim 14, wherein the insulation wall extends from the second end surface of the insertion portion, and wherein a length of the insulation wall from the insertion portion is longer than the length of the second end of the first metallic terminal.

19. The speaker according to claim 14, wherein the insulation wall extends from the second end surface of the insertion portion, and wherein the insertion portion includes a first portion from which the second end of the first metallic terminal protrudes, a second portion separated from the first portion by a groove, the second portion being resiliently bendable toward the first portion, and a retainer protrusion formed at a free end of the second portion.

20. The speaker according to claim 14, further comprising a second connection terminal having a second holder and a second metallic terminal embedded therein, wherein the first end surface of each of the first and second holders extending outside the frame being marked to indicate the electrical polarity of each of the first and second metallic terminals.

21. The speaker according to claim 14, wherein a second connection terminal is mounted on the frame, the second connection terminal having embedded therein a second metallic terminal, wherein a face of each of the connection terminal and the second connection terminal is colored to indicate an electrical polarity of each of the first metallic terminal and the second metallic terminal.

22. The speaker according to claim 14, wherein a second connection terminal is mounted on the frame, the second connection terminal having embedded therein a second metallic terminal, and wherein a face of each of the connection terminal and the second connection terminal is marked to indicate the electrical polarity of each of the first metallic terminal and the second metallic terminal.

* * * * *